US006244560B1

(12) United States Patent
Johnson

(10) Patent No.: US 6,244,560 B1
(45) Date of Patent: Jun. 12, 2001

(54) BLOWOUT PREVENTER RAM ACTUATING MECHANISM

(75) Inventor: Chris Dale Johnson, Houston, TX (US)

(73) Assignee: Varco Shaffer, Inc., Houston, TX (US)

( * ) Notice: Subject to any disclaimer, the term of this patent is extended or adjusted under 35 U.S.C. 154(b) by 0 days.

(21) Appl. No.: 09/540,071

(22) Filed: Mar. 31, 2000

(51) Int. Cl.[7] ..... E21B 33/06

(52) U.S. Cl. ..... 251/1.3; 92/61; 92/151; 91/519

(58) Field of Search ..... 251/1.1, 1.3, 25; 92/61, 62, 151, 152; 91/519

(56) References Cited

U.S. PATENT DOCUMENTS 5,205,200 * 4/1993 Wright ..... 92/62 X
5,320,325 * 6/1994 Young et al. ..... 251/1.3
5,575,452 * 11/1996 Whitby et al. .
5,590,867 * 1/1997 Van Winkle ..... 251/1.3
5,735,502 * 4/1998 Levett et al. ..... 251/1.3
5,806,314 * 9/1998 Younes ..... 92/151 X
5,975,484 * 11/1999 Brugman et al. .

* cited by examiner

*Primary Examiner*—Kevin Lee
(74) *Attorney, Agent, or Firm*—Browning Bushman

(57) ABSTRACT

A ram actuating mechanism 20 for a blowout preventer 10, the ram actuating mechanism 20 including a hydraulic booster for enhancing the ram closing force. The ram actuating mechanism 20 may be compatible for use with primary pistons 25 which include internal moving components, such as self locking pistons. The ram actuating mechanism 20 providing a hydraulic booster without increasing the diameter of the booster pistons above the diameter of the primary piston, such that BOP stack height need not be increased to accommodate a relatively large diameter hydraulic booster. The ram actuating mechanism 20 may utilize the same piston housing 60 as used by the primary piston, and the booster pistons 26, 28 may act mechanically in series upon the primary piston 25 to increase axial ram closing force. The ram actuating mechanism 20 may be capable of retro-fitting existing ram actuating mechanisms.

23 Claims, 4 Drawing Sheets

BLOWOUT PREVENTER RAM ACTUATING MECHANISM

FIELD OF THE INVENTION

The present invention relates generally to an actuating mechanism for a ram-type blowout preventer of the type used in drilling subterranean wells. More specifically, this invention relates to an improved blowout preventer hydraulic boost system which may enhance the ram closing force for a given hydraulic pressure input. Significant advantages of this booster system over the prior art include: 1) no need to increase the blowout preventer height, and 2) the booster may be compatible with ram hydraulic actuators which include internal locking mechanism parts.

BACKGROUND OF THE INVENTION

Blowout preventers (BOPs) are commonly used substantially at or near the surface to control sub-surface pressures encountered when drilling subterranean wells. BOPs have been used for decades and are an important part of the well drilling system. BOP actuation forces for operating a ram block may include manual mechanisms and pneumatic or hydraulic pressure which may act upon a piston to close or open ram sealing elements. Hydraulic actuation may generally be preferred when the required closing forces are relatively high. The hydraulic actuation force may be applied to a cylinder containing a piston which in turn may act upon a shaft having a ram element attached to the near end of the shaft opposite the piston. In such installations, the closing force may be substantially equivalent to the effective cross-sectional area of the piston multiplied by the pressure of the hydraulic fluid.

In certain applications, it is desirable to apply an enhanced closing force to the rams, e.g., when using shear rams. To achieve the desired closing forces, a prior art solution has been to add a hydraulic booster to ram actuator assembly to increase the effective closing force for a given hydraulic actuation pressure. This prior art hydraulic booster is discussed subsequently. Alternatively, the hydraulic actuation pressure may be enhanced so as to increase the closing force without relying upon boosters. This latter technique may result in a preventer stack assembly which operates with hydraulic fluids at different pressures, thereby increasing system complexity. Preventer ram actuators may typically operate at hydraulic pressures of 1500 or 3000 psig. Where enhanced closing force is required, pressures may be increased to 5000 psig. Some components in the preventer stack may not be designed to handle the higher hydraulic pressures, thereby resulting in a preventer system with more than one independent pressure system. Increasing the hydraulic pressure upon the booster piston may undesirably increase the complexity and safety concerns involving the actuation system. All components in a preventer system may not be rated to the higher pressures, and more than one actuation system may have to be provided and operated to accommodate all components in the higher pressure system. Accordingly, the solution of raising the hydraulic pressure to the ram actuator is not favored, particularly when a substantial increase in the closing force is required.

A hydraulic booster may be placed in series with a main actuator piston. Typically the hydraulic booster provides a piston which has a larger cross-sectional area upon which the hydraulic pressure acts, thereby increasing the closing force. The booster piston may be attached to a far end of a booster guide rod and the near end of the booster guide rod may then act upon the high pressure side of the main actuator piston. The net closing force upon the primary piston shaft is accordingly increased by the mechanical force to the main actuator piston resulting from hydraulic pressure to the booster piston.

One problem with prior art booster pistons is the need for increased preventer height to accommodate the increased diameter of the booster piston. A short preventer stack height is typically preferred. U.S. Pat. No. 5,957,484 discloses a preferred technique to easily and reliably lock the door of a BOP actuating mechanism to the BOP body, with one benefit being a vertically short BOP. Booster pistons providing larger diameter pistons also require larger diameter housings which result in increased stack height. In addition, increased diameter piston housings may also require increased wall thickness, which, in combination with the increased housing circumference, may result in an excessive amount of weight to the BOP stack.

A second problem with prior art hydraulic boosters may be encountered where the booster guide rod acts upon a primary piston assembly having internal moving parts, such as an automatic internal locking system. Operation of the main actuator assembly may preclude the application of force, such as by a booster guide rod, to the center of the primary piston. For example, U.S. Pat. No. 5,575,452 discloses a blowout preventer ram actuator mechanism, wherein the primary piston includes an outer sleeve portion which supports an independently movable locking piston. The locking piston has tapered surfaces, and locking segments each engage one of a plurality of tapered locking rods fixed to the actuating mechanism housing. Due to the locking piston components which move independently of the primary piston, an axially centered boosting force may not be exerted directly against these internal moving parts without risking premature locking of the primary piston. Other BOP ram actuating mechanisms may similarly include centrally located parts which limit or preclude the use of a conventional booster piston.

An additional problem with prior art hydraulic boosters involves the increased number of seals between components. The addition of a hydraulic booster may expose additional sets of external seals, thereby increasing the risk of leaking hydraulic fluid to the environment.

The disadvantages of prior art are overcome by the present invention, and an improved ram actuating mechanism with hydraulic boost capability is hereafter disclosed. The improved ram actuating mechanism is relatively simple, is highly effective and reliably provides a mechanism to significantly enhance or boost the actuation force in a ram type preventer.

SUMMARY OF THE INVENTION

A blowout preventer (BOP) ram activating mechanism is disclosed for opening and closing the ram of a ram-type blowout preventer with enhanced force upon the ram block or ram head. An internal boost system is provided which effectively boosts the actuation force upon the ram rod which is attached to the ram block. The system may be applicable to pipe rams for sealing around a tubular element, shear rams for shearing one or more tubular elements and blind rams for sealing an open wellbore in the absence of a tubular element extending through the preventer. The improved ram actuating mechanism may be used in a ram type preventer assembly to power or drive one of two opposing ram blocks. A BOP will typically include two ram actuating mechanisms as disclosed herein. The ram activating mechanism may be used in various ram type BOPs.

A preferred embodiment of the blowout preventer ram activating mechanism may include two booster pistons, a primary piston, a ram rod, a ram block and a piston housing. The ram block may include the seal and/or shear components. The ram rod may be attached at its near end to the ram block and may be attached on its far end to the primary piston. The primary piston and booster pistons may be hydraulically powered and linearly moveable in a piston housing between ram opened and ram closed positions. The primary piston and, in a preferred embodiment, two booster pistons, share a common cylinder or piston housing with a uniform cylinder bore size along its axial length, with the booster pistons acting in series upon the primary piston. The booster pistons may act upon a perimeter area of the primary piston in a manner which does not interfere with internal workings of the primary piston. All pistons may move individually along a common cylinder housing central axis in response to hydraulic pressure. Only a single cylinder or piston housing is thus required. A piston housing may be defined as including a housing sleeve and an end cap, the piston housing being sealingly secured to a front plate, thereby defining a chamber in the piston housing. The chamber may include a two or more sub-regions within the chamber, which may, collectively with the components in the chamber, generally define the volume of the chamber. Each subregions may or may not be hydraulically isolated from other sub-regions.

A primary piston may be assisted by one or more internal booster pistons. The booster pistons may act in series to apply a mechanical force against the primary piston. The piston housing may include a piston housing ram block end which may be removably fixed to the blowout preventer ram door or front plate, and an end cap end which may substantially enclose the rear end of the piston housing and forming the piston receiving chamber within the piston housing.

With the ram actuating mechanism in the opened position, the primary piston shaft may be generally retracted into the piston housing. To close the ram block, a closing hydraulic force may be applied substantially simultaneously to an end cap side of each of the three pistons, i.e., the primary piston and the two booster pistons. The high pressure hydraulic fluid may be supplied to the piston chambers through a passageway in the front plate, a tube extending from the front plate to the end cap, and a passageway in the end cap. This pressurized fluid may result in an axial movement of each of the three pistons within the piston housing and toward the front plate end of the piston housing. The pressurized hydraulic fluid may move between the OD of each booster piston and the ID of the piston housing. The primary piston may provide seals between the OD of the primary piston and the ID of the piston housing. The booster pistons are placed in series with the primary piston. The first or near booster piston may engage the primary piston, while the second or far booster piston may be positioned between the first booster piston and the end cap, and may engage the first booster piston. When the actuating mechanism is in the opened position, the rear or second booster piston may be positioned substantially adjacent to the end cap. The three pistons may not be internally connected, and thus the ram opening force may not be increased with this combination. All pistons may share a central axis through the piston housing.

The end cap may be sealingly secured to the far end of the piston housing and the piston housing may be sealing secured to the front plate, defining a piston chamber in the housing. A stationary booster guide rod may be affixed to the end cap and may extend inside of the piston housing. The guide rod may extend through the one or more booster pistons along the central axis of the piston housing. A hydraulic seal may be provided between each moveable booster piston and a single block affixed to the guide rod. The guide rod may thus include two stationary booster piston guide blocks affixed to the guide rod.

Each booster piston may include a tubular booster piston sleeve. The first booster sleeve may extend axially from the first booster piston end plate toward the primary piston and beyond the first stationary booster piston guide block for a distance which exceeds the stroke length of the actuating mechanism. The second booster sleeve may extend axially from the second booster piston end plate toward the first booster piston and beyond the second stationary booster piston guide block for a distance which may exceeds the stroke length of the actuating mechanism. Hydraulic pressure may be applied to the piston housing which may cause each booster piston to move inside of the piston housing during opening and closing of the actuating mechanism. During booster piston movement, the sleeve portion of each booster piston moves in the annulus between the stationary booster piston guide block and the ID of the piston housing. A hydraulic seal may be provided between the ID of each booster sleeve and the OD of the respective stationary booster piston guide block.

Hydraulic fluid is generally present on each side of each piston. To move a ram actuating mechanism from the opened position to the closed position, a pressurized hydraulic fluid may be injected into the high pressure "ram closing" sub-regions inside of the piston housing to cause the ram actuating mechanism to move toward the closed position. During such movement, fluid in the low pressure sub-regions within the piston housing may be simultaneously displaced from "ram opening" sub-regions in the piston housing, to a fluid reservoir. Conversely, to cause the ram actuating mechanism to axially move toward the end cap end of the piston housing, and thus the actuating mechanism to the ram opened position, pressurized fluid may be injected into high pressure "ram opening" sub-regions inside of the piston housing. During this ram opening movement, low pressure hydraulic fluid may be simultaneously displaced from the low pressure "ram closing" regions in the piston housing to the fluid reservoir.

It is an object of the present invention to provide an improved, hydraulic ram actuating mechanism to enhance ram closing force. This invention provides a ram actuating mechanism which effectively increases the net closing and/or shearing force available at the ram block assembly. The mechanism and method relied upon to achieve this enhanced closing force are simple, reliable and rugged.

It is another object of the invention to provide a ram actuator assembly including a booster mechanism which need not increase the height of the preventer. The booster pistons of this invention may share a common bore size and common cylinder with the primary piston. No increase in piston housing diameter above that required for the primary piston is required, although the closing force may be significantly increased. The axial length of the piston housing from the actuator front plate to the end cap will be longer than the axial length of an unboosted piston housing. Actual length may vary depending upon the number or booster pistons added to the actuator assembly.

It is a feature of the invention that the booster system of this ram actuating mechanism be compatible with a primary piston which includes internal working components, such as a self locking piston and other internal piston locking mechanisms. A booster piston of this invention may be adapted to a wide variety of primary pistons that include internal working components. The area of contact between the booster piston and primary piston may be configured such that the boost force is applied to the primary piston without interfering with internal working components.

It is another feature of this ram actuating mechanism that the booster assembly may boost ram closing force without resorting to a higher hydraulic fluid pressure. This invention may achieve an enhanced ram closing force on a BOP stack while maintaining a common BOP stack system pressure. This booster system may thus be compatible with other hydraulic components in a BOP stack and does not require separate hydraulic pressure systems to obtain the required closing forces. The operator may retain the option of increasing the hydraulic pressure in the system or in portions of the system, if desired, in order to facilitate additional increases in ram actuation force.

It is also a feature of this invention that any number of the booster piston and stationary booster piston guide blocks may be coupled in series to increase ram actuating mechanism forces. The basic operating principles underlying this booster piston concept, including the hydraulic piston sleeve and piston guide block components, may thus be applied to any number of sequentially connected booster pistons. In a preferred embodiment including two booster pistons and a primary piston, during ram actuating mechanism closing operations, the second booster piston may axially act upon a first booster piston, which in turn may act upon a primary piston. Thus, all three pistons may contribute to a combined, total closing force.

It is yet another feature of this invention that the booster and primary pistons may share a common cylinder, thereby reducing the need to combine multiple cylinder assemblies which would otherwise undesirably result in additional seal sets in the ram actuating mechanism assembly. The total number of seals required for this invention is less than the number of seals needed to connect an equivalent number of booster operators having separate cylinders. By minimizing the number of components, the simplicity and reliability of the boosted ram actuating mechanism may be enhanced while minimizing the opportunities for seal failure, leaks and corrosion. An additional feature of this invention is that the ram actuating mechanism may be applied to preventers having front plates that bolt directly to the preventer body, hinged front plates that may swing open, and front plates which may be attached to preventer bodies by other mechanisms, such as bar locks.

An advantage of this ram actuating mechanism invention is that the ram actuation force available to close and/or open a ram block assembly may be significantly enhanced by this ram actuating mechanism. A related advantage is that the force increase may be achieved without increasing hydraulic pressure to the actuator assembly.

It is also an advantage of this invention that the ram actuation force may be boosted without increasing the diameter of the ram actuator. This may facilitate BOP stack height reductions, which may also facilitate providing additional sets of BOPs in the BOP stack.

An important advantage of this ram actuating mechanism is that the booster system may be used with a primary piston which has internal working components. This may be advantageous in facilitating adaptation of the boost mechanism to a primary piston having a locking mechanism, such as a wedge-lock mechanism, which would otherwise be interfered with by a prior art boost shaft which acts upon the center region of the primary piston.

These and further objects, features and advantages of the ram actuating mechanism will become apparent from the following detailed description, wherein reference is made to the figures in the accompanying drawings.

DETAILED DESCRIPTION OF PREFERRED EMBODIMENTS

Figure 1:
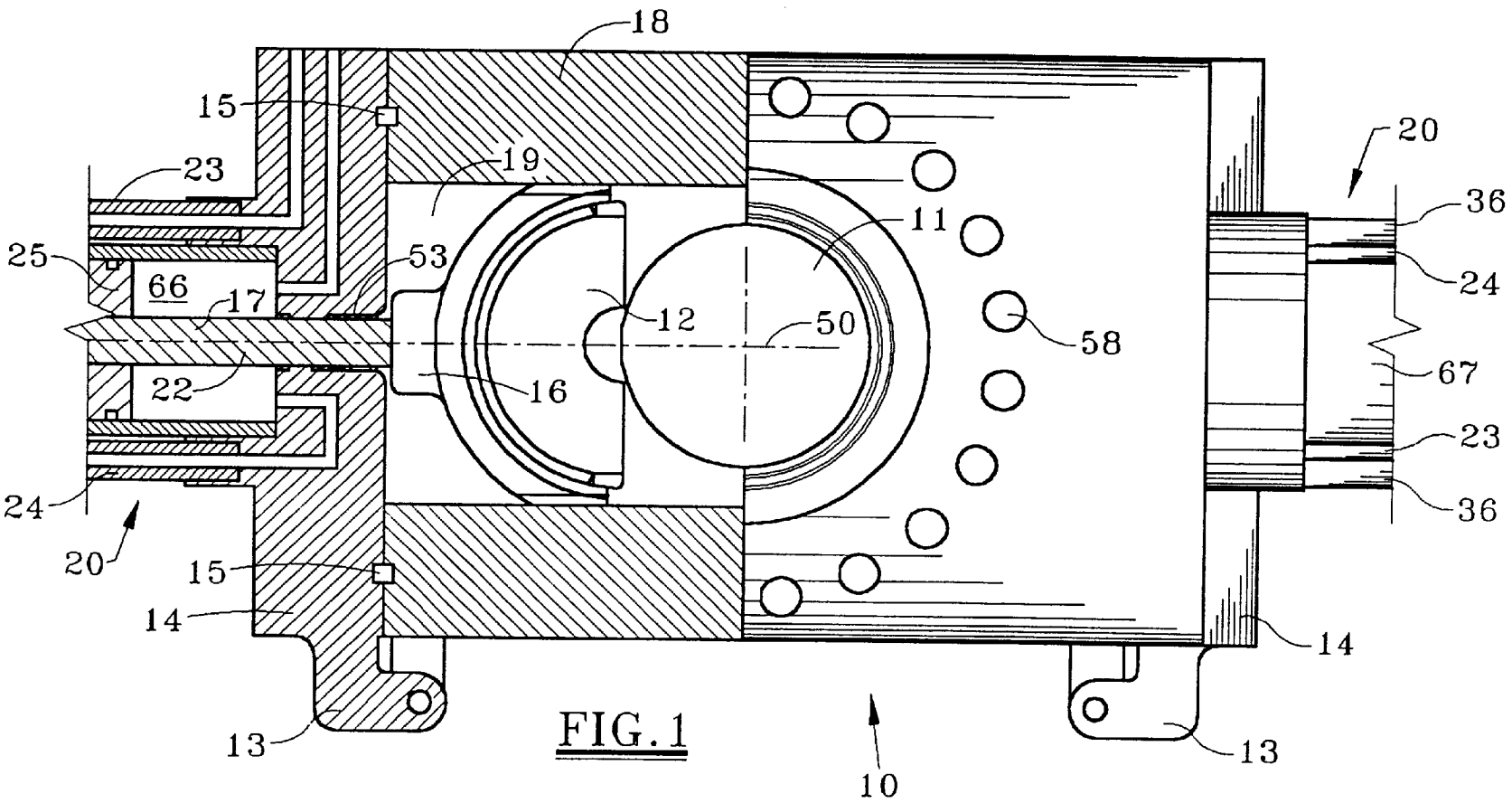
FIG. 1 is a top view of a blowout preventer, in half cross-section, illustrating only a portion of two opposing ram actuating mechanisms.

FIGS. 1 illustrates a top view of a ram type blowout preventer 10 in half cross-section, including a ram block 12 retracted in the opened position such that a primary through bore 11 exists through the blowout preventer housing 18. The primary through bore 11 is generally a vertical passageway for the passage of tubular members of varying diameters.

The ram blocks 12 may be interchanged as appropriate to accommodate the tubulars to be passed through the primary through bore 11. BOPs may be stacked vertically and connected to a casing head (not shown) or other component through bolt holes 58. This invention may be applicable to various types of ram blocks 12, including pipe rams, blind rams, stripping rams and blind shear rams. Structurally similar ram actuating mechanisms 20 are partially illustrated on opposite sides of the preventer housing 18, with one of the partially illustrated actuating mechanisms 20 shown in cross-section.

Each actuating mechanism 20 may include a front plate 14. Opposing actuator mechanisms may be aligned such that each ram block 12 may reciprocate or move axially along a substantially common central axis 50. The front plate 14 may be a door type frontplate including a hinge assembly 13. The front plate 14 may be an unhinged front plate, and/or the front plate 14 may incorporate a bar-lock mechanism to connect the ram actuating mechanism 20 to the preventer housing 18 using a locking bar (not shown). The front plate may thus be any other type of front plate 14 as may be connected to a preventer housing 18. The front plate 14 of the ram actuating mechanism 20 may be structurally secured into sealing engagement with the preventer housing 18 by circumferentially arranged nuts and bolts, or a bar-lock or any other mechanism for removably attaching and securing the front plate 14 to the preventer housing 18. A front plate seal 15, such as an O-ring, gasket or metal ring-seal, may be provided in the groove 57 and seal between the preventer housing 18 and the front plate 14.

Referring to FIGS. 1, 2, 3 and 4, in a preferred embodiment the preventer housing 18 may include a ram cavity 19 for positioning the ram block 12 in the opened position. The ram block 12 may include a ram foot 16 which may be attached to a ram rod 22. The front plate 14 may include a ram foot recess profile 55 to accommodate the ram foot 16 with the ram block 12 in the fully opened position. A ram foot guide slot 56 may be provided in the front plate 14 to maintain proper alignment of the ram block 12 with respect to the ram housing 18. The front plate 14 may also provide a ram rod through bore 17, with the central axis of the ram rod through bore 17 being aligned along the central axis 50.

A preferred embodiment of the ram actuating mechanism 20 includes a generally cylindrical, sleeve shaped piston housing 60. The piston housing 60 may include a housing sleeve 67 and an end cap 35. The housing sleeve 67 may include a substantially uniform internal diameter through bore extending from the end cap 35 to the front plate 14, forming a hydraulic piston chamber within in the housing sleeve 67. The end cap 35 may be in hydraulic sealing engagement with the housing sleeve 67. The housing sleeve 67 may be in hydraulic sealing engagement with the front plate 14. A plurality of conventional threaded securing rod 37 and nut 36 components may be circumferentially provided, external to the cylindrical housing sleeve 67, for interconnecting the end cap 35 with the front plate 14. The piston housing 60 includes a central axis 50 through the through bore, along which moveable internal components may axially reciprocate between the opened and closed positions.

The front plate 14 may include a first front plate ram movement hydraulic fluid passage 31 for conducting hydraulic fluid between the piston housing 60 and a hydraulic fluid pressure source 96 or a hydraulic fluid reservoir 95. (See FIG. 2.) The front plate 14 may also include a second front plate ram movement hydraulic fluid passage 54 for conducting hydraulic fluid between the chamber in the piston housing and a hydraulic fluid reservoir 95 or the hydraulic fluid pressure source. Depending upon the direction of reciprocation, one of the first 31 or second 54 front plate ram movement hydraulic fluid passages will serve as the high pressure passage conducting fluid into the piston housing 60, and the other will serve as the low pressure passage conducting fluid out of the piston housing 60. A front plate hydraulic fluid circulation port 33 may conduct hydraulic fluid between a first hydraulic region 61, defined subsequently, and a ram opening flow line 24.

Each ram actuating mechanism 20 may control the opening and closing of a ram block 12, the ram block 12 being axially moveable along the central axis 50 within the preventer housing 18. The ram actuating mechanism 20 may include a front plate 14, piston housing 60, primary piston 25, ram rod 22, ram closing flow line 23, ram opening flow line 24, one or more stationary booster piston guide blocks 27, 29, a guide rod 41, one or more booster pistons 26, 28, and an end cap 35. Substantially all non-component filled with volumes within the piston housing 60 may be occupied by a hydraulic fluid, as each ram actuating mechanism 20 is hydraulically powered. An opened ram actuating mechanism 20 may be moved to a closed position by injecting pressurized hydraulic fluid into the high pressure sub-regions 61, 62, 63, (defined subsequently) within the piston housing 60. This high pressure fluid may effect movement of the pistons 25,26,28, ram rod 22 and ram block 12. Such movement will result in displacement of low pressure hydraulic fluid from the low pressure sub-regions 64, 65, 66 (defined subsequently) of the piston housing 60, into a fluid reservoir 95.

A primary piston 25 may be included within the piston housing 60, the primary piston 25 being axially moveable along the central axis 50. The primary piston 25 may include at least one primary piston seal 34 radially encompassing the primary piston 25 which may form a hydraulic seal between the primary piston 25 and the piston housing 60 as the primary piston 25 reciprocates within the housing sleeve 67. The primary piston 25 may be attached to a ram rod 22, the ram rod 22 having a ram rod central axis which is common with the central axis 50. The ram rod 22 may extend axially from the point of attachment to the primary piston 25, through a ram rod through bore 17 in the front plate 14, and into a ram body cavity 16 in the preventer housing 18. Ram rod seals 53 may form a hydraulic seal in the ram rod through bore 17, and between the ram rod 22 and the front plate 14 as the ram rod may be reciprocated through the ram rod through bore 17. The ram rod seal 53 may be enhanced by injecting a packing material through a packing conduit 52 in the front plate 14.

A guide rod 41 may be attached to the end cap 35 and extend axially into the piston housing chamber. The guide rod 41 includes a guide rod central axis which may be substantially the same as the central axis 50. The guide rod 41 may include an end cap end 71 which is attached to the end cap 35, and a piston end 72. The guide rod 41 may be attached to the end cap 35 by threaded connection 97. The piston end 72 may be attached to a stationary first booster piston guide block 27. The guide rod 41 may be secured to the first booster piston guide block 27 by threaded connection 98. The guide rod 41 may include a stationary second booster piston guide block 29 positioned between the end cap end 71 of the guide rod 41 and the stationary first booster piston guide block 27. The second booster piston guide block 29 may be secured to the guide rod 41 by threaded connection 99. The guide rod 41 may be comprised of two segments 73, 74 which connect to each other at substantially the second booster piston guide block 29 to permit attaching the second booster piston guide block 29 to the guide rod 41. The guide rod 41 may include a guide rod through bore 42 substantially parallel to the central axis 50 for conducting a portion of the hydraulic fluid through the guide rod 41, and hydraulic fluid ports 43,45, in fluid communication with guide rod through bore 42. The first booster piston guide block 27 may include a hydraulic fluid port 45 for conducting hydraulic fluid between the guide rod through bore 42 and sub-region 65 in the piston housing 60. The second booster piston guide block 29 may include a hydraulic fluid port 43 for conducting hydraulic fluid between the guide rod through bore 42 and sub-region 64 in the piston housing 60. The end cap 35 may include an end cap opening pressure hydraulic fluid passageway 39 for conducting hydraulic fluid between the rain opening flow line 24 and the guide rod through bore 42. The end cap 35 may include an end cap closing pressure hydraulic fluid passageway 38 for conducting hydraulic fluid between the ram closing flow line 23 and a sub-region 61 in the piston housing 60.

The housing sleeve 67 may encase a first booster piston 26 and a second booster piston 28. The first booster piston 26 may include a first booster piston end plate 48 spaced between the first booster piston guide block 27 and the second booster piston guide block 29. The first booster piston end plate 48 may include a through bore 68 therein for receiving the guide rod 41. The first booster piston end plate 48 may reciprocate axially along the guide rod 41 and a hydraulic seal 75 may be included in the through bore 68, between the first end plate 48 and the guide rod 41.

The second booster piston 28 may include a second booster piston end plate 48 spaced between the second booster piston guide block 29 and the end cap 35. The second booster piston end plate 49 may include a through bore 69 therein for receiving the guide rod 41. The second booster piston end plate 49 may reciprocate axially along guide rod 41 and a hydraulic seal 76 may be formed in the through bore 69, between the second end plate 49 and the guide rod 41.

A sleeve shaped first booster piston sleeve 77 may be provided between the first stationary booster piston guide block 27 and the inner wall 59 of the housing sleeve 67. A first end plate end 81 of the first booster piston sleeve 77 may be affixed to the first sleeve side 83 of the first booster piston end plate 48, forming a substantially cup-shaped, first booster piston 26. The first booster piston sleeve 77 and the first end plate 48 may reciprocate during ram opening an closing, in unison, along the central axis 50, in hydraulic sealing engagement with the guide rod 41 and the first stationary booster piston guide block 27. A first front face 82 of the first booster piston sleeve 77 may mechanically contact the closing face side 84 of the primary piston 25. The first booster piston sleeve 77 may not be in sealing engagement with the inner wall 59 of the housing sleeve 67, thereby permitting hydraulic fluid to migrate between the first booster piston 26 and the inner surface 59 of the housing sleeve 67. A first booster piston guide block seal 47 may be included and may provide a hydraulic seal between the ID of the first booster piston sleeve 77 and the OD of the first stationary booster piston guide block 27.

A sleeve shaped second booster piston sleeve 78 may be provided between the second stationary booster piston guide block 29 and the housing sleeve 67. A second end plate end 85 of the second booster piston sleeve 78 may be affixed to the second sleeve side 86 of the second booster piston end plate 49, forming a substantially cup-shaped, second booster piston 28. The second booster piston sleeve 78 and the second end plate 49 may reciprocate during ram opening and closing, in unison, along the central axis 50, in hydraulic sealing engagement with the guide rod 41 and the second stationary booster piston guide block 29. A second front face 88 of the second booster piston sleeve 78 may mechanically contact the closing face side 87 of the first booster piston 26, without forming a hydraulic seal between the second front face 88 of the second booster piston sleeve 78 and the closing face side 87 of the first booster piston 26. The second booster piston sleeve 78 may not be in sealing engagement with the housing sleeve 67, thereby permitting hydraulic fluid to migrate between the second booster piston 28 and the inner surface 59 of the housing sleeve 67. A second booster piston guide block seal 46 may be included and may provide a hydraulic seal between the ID of the second booster piston sleeve 78 and the OD of the second stationary booster piston guide block 29.

To effect reciprocation or displacement of the ram actuating mechanism between opened and closed positions, the primary piston 25 may be hydraulically displaced such that the ram rod 22 axially moves the ram block 12. Axial force upon the ram rod 22 while moving the ram block 12 in the closing direction may be enhanced through hydraulic actuation of the booster pistons 26, 28. In a preferred embodiment, the first booster piston 26 is not connected to the primary piston 25 to provide tensional assist to the primary piston 25 in opening the ram block 12. The opening movement of the ram block 12 is thereby preferably unboosted. Although during opening, all three pistons 25, 26, 28 may move axially in an opened direction, only the main piston 25 may be moving the ram block 12. Alternatively, if it is desired to enhance the opening movement of the ram block 12, the first booster piston 26 may be connected to the primary piston 25. Through such connection at least one booster piston 26, 28 may assist the primary piston 25 in opening the ram block 12. In a preferred embodiment as illustrated in FIGS. 1, 2, 3, and 4, the piston housing 60 of the actuator mechanism may include generally six hydraulic chamber sub-regions 61, 62, 63, 64, 65, 66. To close the ram actuating mechanism which is in the opened position, hydraulic pressure 96 may be applied by a hydraulic pump, accumulator package, pressurized gas cylinders or otherwise. To effect movement of the ram actuating mechanism 20 to the closed position, high pressure hydraulic fluid may be supplied to the actuator mechanism through a fluid path which may be defined through the front plate ram movement hydraulic fluid passage 31, the ram closing flow line 23 and the end cap closing pressure hydraulic fluid passageway 38, and first 61, second 62 and third 63 hydraulic sub-regions. The first hydraulic sub-region 61 may generally be defined as the region in the piston housing 60 between the second booster piston end plate 49 and the end cap 35. High pressure hydraulic fluid may migrate and hydraulic pressure may be transmitted through the annulus between the ID of the housing sleeve 67 and the OD of the second booster piston 28, through hydraulic port 92 and into a second hydraulic sub-region 62.

The second hydraulic sub-region may be defined as that region generally within the piston housing 60 between the second stationary booster piston guide block 29 and the first booster piston end cap 48. From the second hydraulic sub-region 62, the high pressure hydraulic fluid may migrate and hydraulic pressure may be transmitted through the annulus between the ID of the housing sleeve 67 and the OD of the first booster piston 26, through hydraulic port 93 and into the third hydraulic sub-region 63. The third hydraulic sub-region 63 may generally be defined as that region between the primary piston 25 and the first stationary booster piston guide block 27. As high pressure hydraulic fluid is thus applied to the ram actuating mechanism 20 the acting pressure forces may act substantially in the first 61, second 62 and third 63 sub-regions, generally upon the areas of the primary piston 25, first booster piston 26 and second booster piston 28 which are exposed to the high pressure hydraulic fluid. Reacting forces to the high pressure fluid may generally be carried upon the areas of the end cap 35, second stationary booster piston guide block 29 and first stationary booster piston guide block 27 and guide rod 41, which are exposed to the high pressure fluid. The reactive forces upon the first 27 and second 29 stationary booster piston guide blocks may be transmitted to the end cap 35 through the guide rod 41. The axial loads upon the end cap 35 may be transmitted to the front plate substantially by nut 36 and threaded rod 37 components. The nut 36 and rod 37 components may be positioned substantially circumferentially around and external to the piston sleeve 67. Application of high pressure hydraulic fluid within the first 61, second 62 and third sub-regions 63 may thus react against the stationary components to effect movement of the axially movable components including the ram block 12, ram rod 22, primary piston 25, first booster piston 26 and second booster piston 28, in the ram closed direction. The second booster piston sleeve 78 may mechanically engage the first booster piston end plate 48, and the first booster piston sleeve 77 may mechanically engage the primary piston 25. Closing axial forces upon the ram block 12 may thereby be enhanced by the additional cross-sectional area provided by the booster pistons 26, 28, which may act in series upon the primary piston 25.

As the primary piston 25, first booster piston 26 and second booster piston 28 move in the closing direction, relatively low pressure hydraulic fluid in the fourth 64, fifth 65 and sixth 66 sub-regions in the piston housing 60 may be displaced from the piston housing 60 to a hydraulic fluid reservoir 95. The fourth sub-region may be defined as generally that region between the second booster piston end plate 49 and the second stationary booster piston guide block 29. The fifth sub-region may be defined as that region generally between the first booster piston end plate 48 and the first stationary booster piston guide 27. The sixth sub-region may generally be defined as that region between the primary piston 25 and the front plate 14.

As the second booster piston 28 moves in the closing direction, fluid in the fourth sub-region 64 may be displaced from within the fourth sub-region 64 through a hydraulic port 43 and the through bore 42 in the guide rod 41. From the through bore 42, the fluid may be displaced through the end cap opening pressure passageway 39, the ram opening flow line 24, the front plate hydraulic fluid circulation port 33, the sixth hydraulic fluid sub-region 66, the second front plate ram movement hydraulic passage 54 and then to the hydraulic fluid reservoir 95. Low pressure hydraulic fluid in the fifth sub-region 65 may be displaced from the piston housing 60 through a hydraulic port 45, the through bore 42 in the guide rod 41 and follow the same path thereafter as the fluid from the fourth sub region 64. Low pressure hydraulic fluid in the sixth sub-region 65 may be displaced from the piston housing 60 through the second front plate ram movement hydraulic passage 54 and to the hydraulic fluid reservoir 95.

In opening the ram actuating mechanism 20 from a closed position, the flow of high pressure hydraulic fluid and low pressure hydraulic fluid in the above described closing process may be generally reversed such that the direction of hydraulic fluid flow is substantially reversed. In addition, pressure in the sub-regions which are high pressure sub-regions 61, 62, 63 when closing the ram actuating mechanism become low pressure sub-regions when opening the ram actuating mechanism. Likewise, pressure in the sub-regions which are low pressure sub-regions 64, 65, 66 when closing the ram actuating mechanism become high pressure sub-regions in opening the ram actuating mechanism.

Figure 2:
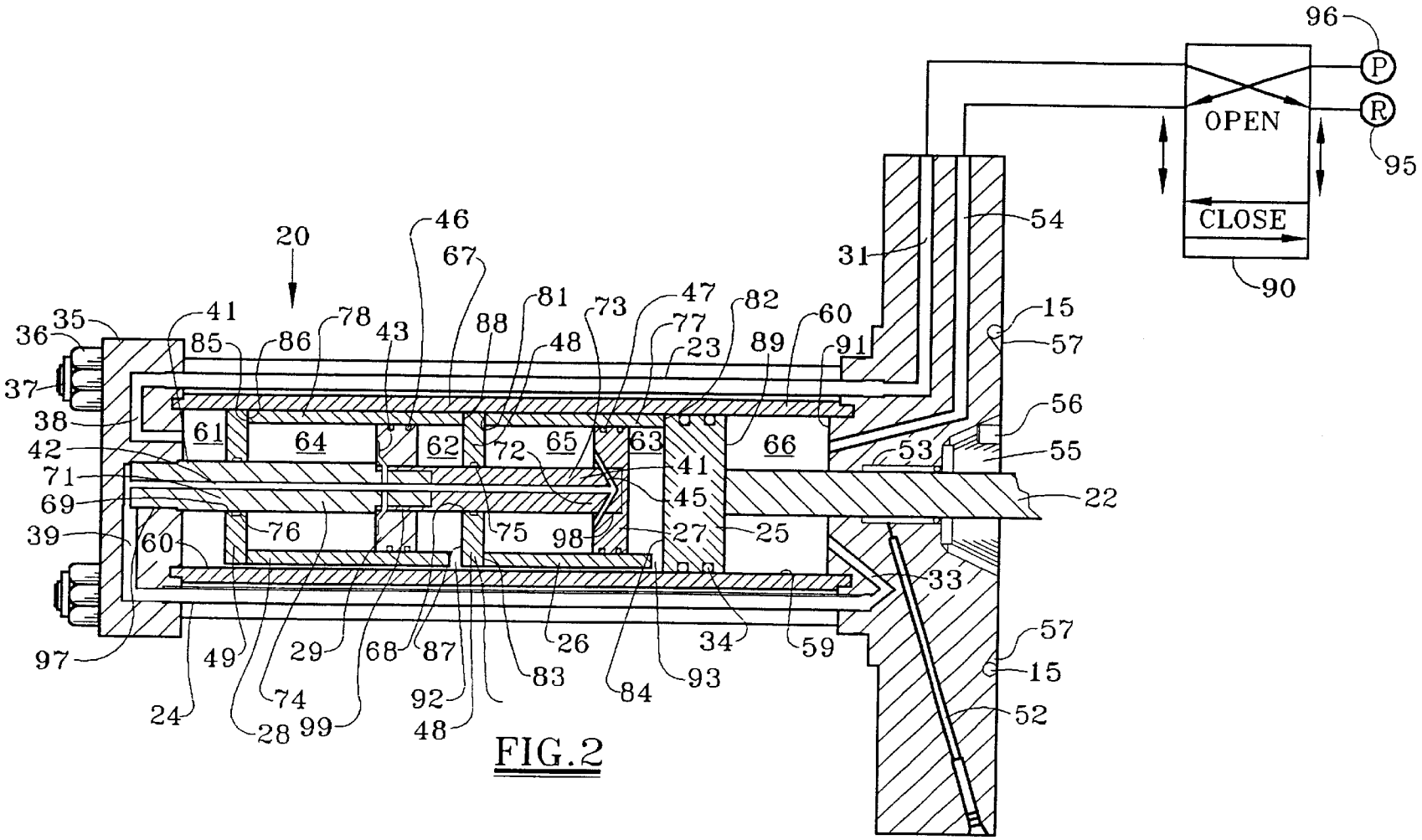
FIG. 2 is a top view of the ram actuating mechanism shown in FIG. 1 in cross-section, illustrating the moveable components generally in the ram opened position and a simplified hydraulic actuating system.
Figure 4:
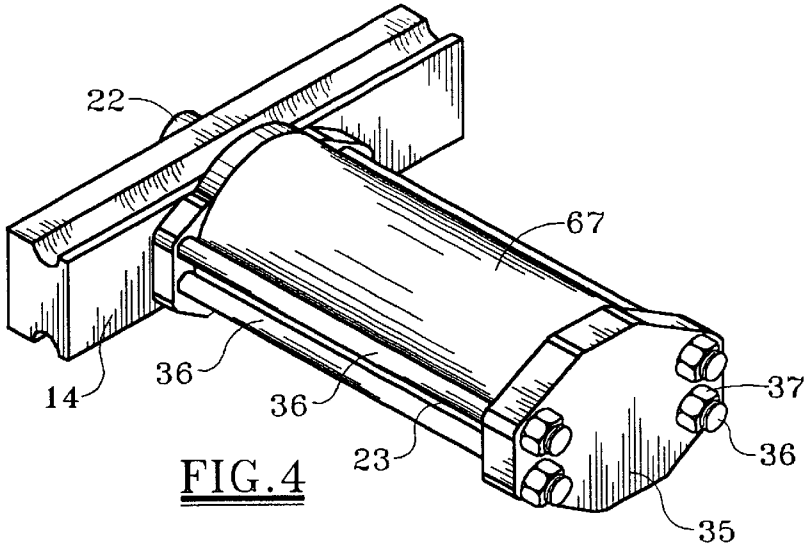
FIG. 4 is a perspective view of a ram actuating mechanism shown in FIGS. 1–3, including grooves for a bar locking mechanism for attaching the front plate to a blowout preventer body.

To open a closed ram block 12, a valve arrangement may be switched, such as illustrated in FIG. 2, by sliding a valve block 90 from the "close" position to the "open" position. High pressure hydraulic fluid may be applied through the second front plate ram movement hydraulic passage 54, the sixth sub-region 66, the front plate hydraulic fluid circulation port 33, ram opening flow line 24, end cap opening pressure hydraulic fluid passageway 39, guide rod through bore 42 and into the fourth 64 and fifth 65 sub-regions in the piston housing 60. Acting in the fourth 64, fifth 65 and sixth 66 sub-regions, the high pressure hydraulic fluid may thereby effect axial movement of the primary piston 25, first booster piston 26 and second booster piston 28, toward the end cap 35. Movement of the primary piston 25, first booster piston 26 and second booster piston 28 may cause displacement of low pressure hydraulic fluid from the first 61, second 62 and third 63 subregions in the piston housing 60, to the reservoir 95.

The ram actuating mechanism 20 of this invention may be retro-fitted onto existing BOPs. The piston housing, hydraulic fluid flow lines, end cap and end cap connecting rods of a prior art ram actuating mechanism may be disconnected from the front plate and primary piston. The piston housing, flow lines, end cap, end cap connecting rods, guide rod, booster piston guides and booster pistons of this invention may be connected to the prior art front plate and primary piston. Such component change may result in converting a previously unboosted ram actuating mechanism or a ram actuating mechanism which included a relatively large diameter booster mechanism, to a boosted ram actuating mechanism that need not increase the height of the BOP stack and which may be compatible with a primary piston which incorporates internal working components.

Various modifications may be made in the preferred embodiment described above. For example, the booster system may include merely a single booster piston, or more than two booster pistons. Numerous variations in flow line, hydraulic fluid port, passage and conduit arrangements are conceivable. Additionally, the primary booster piston may be structurally interconnected with the booster pistons, such that in opening movements, the booster pistons may act mechanically with the primary piston to enhance the opening force upon the ram rod.

Although the preferred embodiment illustrates the piston housing 60 including a piston sleeve 67 and end-cap 35, it will be appreciated by those skilled in the art that the piston housing may be alternatively constructed of a single component or more than two components. In an alternative embodiment, the end cap 35 may be secured to the housing sleeve 67 and the housing sleeve 67 secured to the front plate 14, such that axial loads on the guide rod 41 and axial pressure loads within the piston chamber may be carried through the end cap 35, piston housing 60 and front plate 14 without the need for nuts 36 and studs or rods 37 or other additional load carrying members or studs. The end cap 35, housing sleeve 67 and front plate 14 may be sealingly engaged using studs or rods 37 and nuts 36, integral connections between the components, or fabricated of a unibody construction. Many alternatives may be used for connecting the components of this invention, including threading, welding or other known connection mechanisms.

Figure 3:
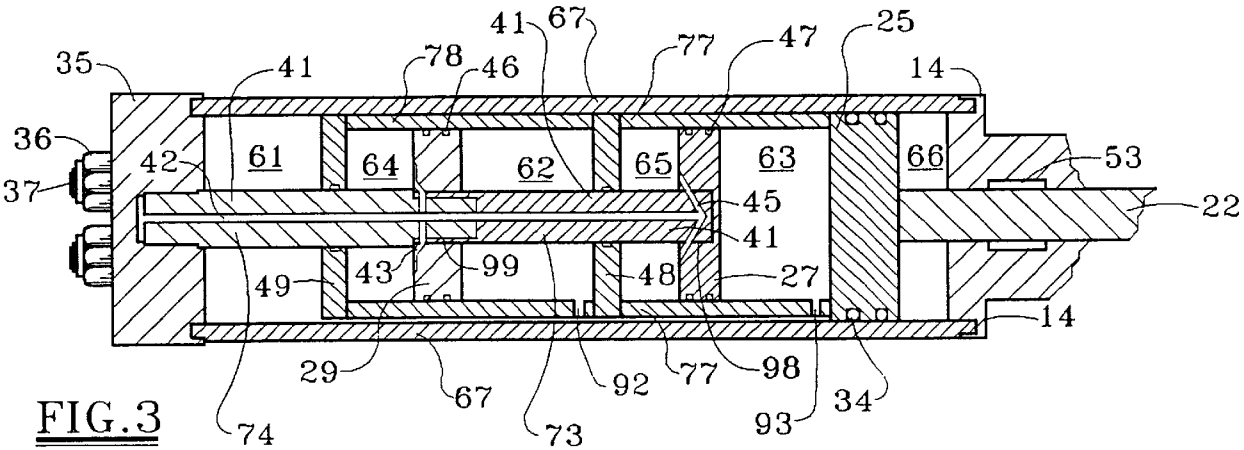
FIG. 3 is a side view of the ram actuating mechanism shown in FIGS. 1 and 2 in cross-section, illustrating the moveable components generally in the ram closed position.

As an alternative to hydraulic ports 92, 93 in piston sleeves 77, 78 as illustrated in FIG. 3, profiles may be provided on the primary piston 25 and/or the first booster piston end plate 48 and/or the end of each piston sleeve 77, 78 as illustrated in FIG. 2, to permit hydraulic fluid to enter and exit the second 62 and third 63 sub-regions. Variations in piston diameter and hydraulic pressures may also be implemented to effect variations in ram actuation force. Additionally, wear rings or wear surfaces may be provided on the OD of the booster pistons 26, 28 to reduce friction and provide a wear surface between the booster pistons 26, 28 and the inner surface 59 of the housing sleeve 67. Alternative embodiments of this invention maybe pneumatically powered, as opposed to being hydraulically powered.

In other alternative embodiments, the first booster piston sleeve 77 may be fixedly secured to the main piston 25 and not fixedly secured to the first end plate 48. The first end plate 48 may not be fixedly secured to the either the first 77 or second 78 booster piston sleeve. The second booster piston end plate 49 may not be secured to the second booster piston sleeve 78. Such embodiments may require additional hydraulic seals, through bores, conduits and ports to effect sub-region hydraulic isolation and hydraulic connectivity between the proper sub-regions during opening and closing movements. Such embodiments may not be favored due to their general complexity and additional wear components, such as moveable seals.

Figure 5:
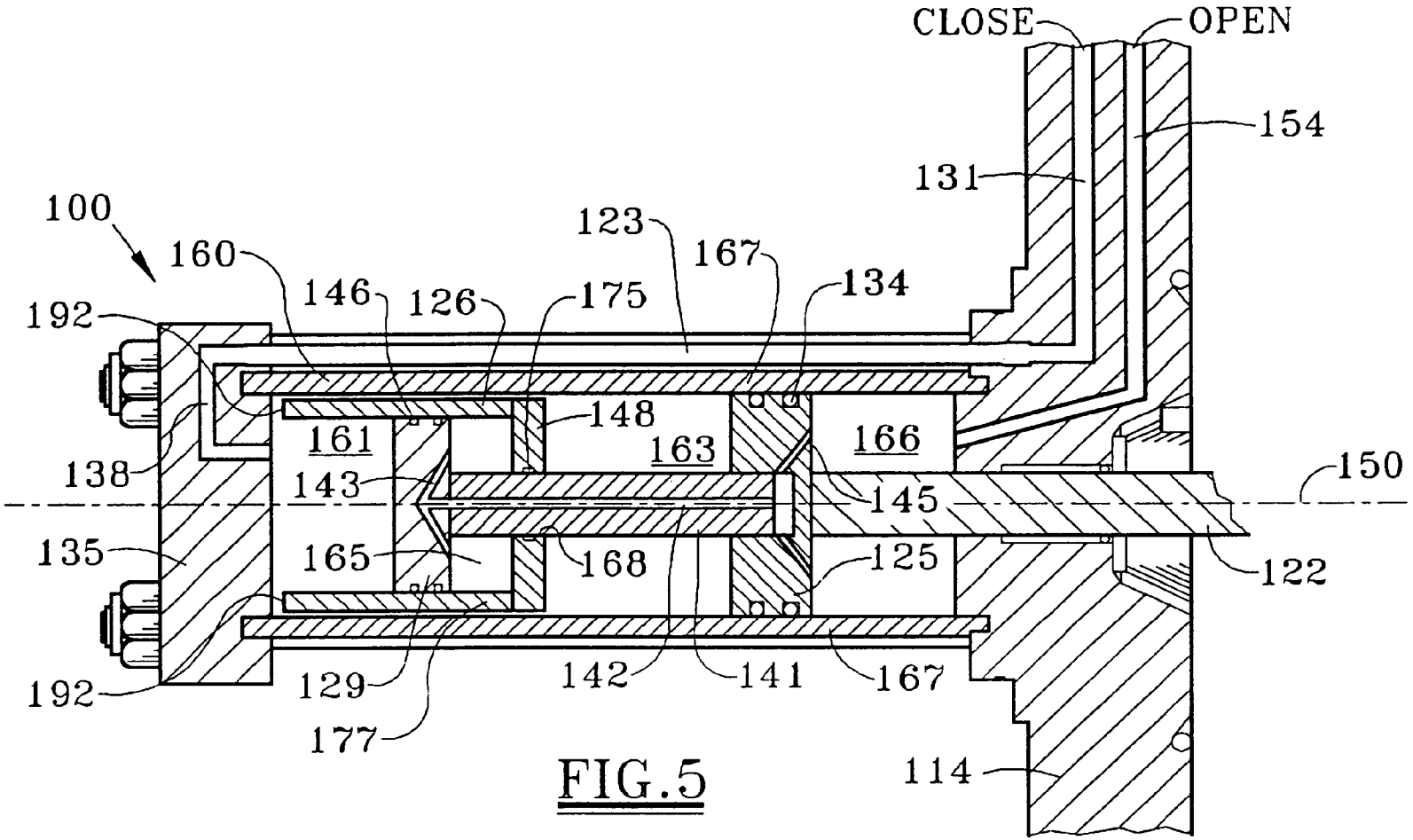
FIG. 5 is a top view of an alternative embodiment of the ram actuating mechanism, in cross-section, illustrating a configuration wherein the booster piston is moveable inside of a booster piston housing, and the ram actuating mechanism does not include a fixedly secured guide rod.

Alternate embodiments for the ram actuating mechanism may include variations in the relative component design, function and configuration. One alternate embodiment of the ram actuating mechanism 100 is illustrated in FIG. 5. This embodiment does not require providing a guide rod that is secured to the end cap and requires only one fluid conduit in the end cap and one less conduit in the front plate than the previously disclosed embodiment. This embodiment may also eliminate one of the fluid conduits which conduct fluid from the front plate to the end cap. These combined advantages may thereby simplify fabrication and construction of the ram actuating mechanism.

The alternative embodiment may include a piston housing 160 sealingly secured to a front plate 114, wherein a through bore in the front plate 114 is penetrated by a ram rod 122 that supports a ram block (not shown). The piston housing 160 may include a housing sleeve 167 which may be sealingly secured to an end cap 135 and the front plate 114, defining a chamber therein, the chamber having a central axis 150. Components may move axially along the centerline 150, in response to hydraulic pressure. A primary piston 125, one or more booster rods 141, one or more booster pistons 129 and one or more booster piston housings 126 may be provided in the chamber. The booster piston housing 126 may include a sleeve portion 177 which is sealingly secured to a booster piston housing front plate 148. The housing front plate 148 may include a port 168 which is penetrated by the booster rod 141.

The booster piston housing 126 as defined in FIG. 5 is not in sealing engagement with the internal wall of the housing sleeve 167, such that hydraulic fluid may freely flow between the booster piston housing 126 and the housing sleeve 167. One or more front plate hydraulic seals 175 may be included in the port 168 between the housing front plate 148 and the booster rod 141. One or more booster piston hydraulic seals 146 may be included between the OD of the booster piston and the ID of the booster piston housing 126. One or more primary piston hydraulic seals 134 may be provided between the OD of the primary piston 125 and the ID of the housing sleeve 167.

The booster piston housing 126 may axially move within the housing sleeve 167. The primary piston 125 may axially move within the housing sleeve 167. The booster piston 129 axially moves within the sleeve portion 177 of the booster piston housing 126. For the embodiment as illustrated in FIG. 5, the booster piston housing 126 is not fixedly secured or otherwise rendered immovable with respect to the piston housing 126 in order to simplify the construction of the ram actuating mechanism. The booster piston rod 141 may be fixedly secured to the booster piston 129, and the opposing end of the booster piston rod 141 may be secured to the primary piston 125.

Referring to the alternative embodiment illustrated in FIG. 5, to close an opened ram actuating mechanism 100, a closing pressure hydraulic fluid may be conducted through the front plate ram closing conduit 131, the ram closing flow line 123, the end cap closing pressure fluid conduit 138 and into a first sub-region 161 within the piston housing 160. The closing pressure hydraulic fluid may be conducted from the first sub-region 161, through a hydraulic fluid port 192, between the booster piston housing 126 and the inner wall of the housing sleeve 167, and into a second sub-region 163. The closing pressure hydraulic fluid may effect axial movement of the primary piston 125 and the booster piston 129 toward the ram actuating mechanism closed position. During the ram actuating mechanism closing movement, low pressure hydraulic fluid may be displaced from within a third sub-region 166 and a fourth sub-region 165 of the piston housing 126. Fluid from the fourth sub-region 165 may be conducted, through a booster piston conduit 143 in the booster piston 129, through a through bore 142 in the booster piston rod 141, through a primary piston conduit 145 and into the third sub-region 166. Fluid from the third sub-region 166 may be conducted from the third sub-region 166 through a ram opening flow line 154 in the front plate 114, and to a fluid reservoir (not shown).

To open a closed ram actuating mechanism 100, an opening pressure hydraulic fluid may be conducted through the ram opening flow line 154 in the front plate 114 and into the third sub-region 166. Fluid from the third sub-region 166 may be conducted through the primary piston port 145, through the through bore 142 in the booster piston rod 141, through the booster piston conduit 143 and into the fourth sub-region 165. The opening pressure hydraulic fluid may effect axial movement of the primary piston 125 and the booster piston 129 toward the ram actuating mechanism 100 opened position.

During the ram actuating mechanism opening movement, low pressure hydraulic fluid may be displaced from within the second sub-region 163, through the annulus between the booster piston housing 126 and the housing sleeve 167, through a booster piston housing fluid port 192, and into the first sub-region 161. Low pressure fluid from the first sub-region 161 may be displaced through the end cap closing pressure fluid conduit 138, through the ram closing flow line 123, through the front plate ram closing conduit 131 and into the fluid reservoir (not shown).

The alternate embodiment of the ram actuating mechanism 100 as illustrated in FIG. 5 may provide many of the benefits of this invention, including utilizing a booster piston arrangement that fits within the primary piston diameter. In addition, with conforming adaptation of the booster rod to the primary piston configuration, this alternative booster piston arrangement may be compatible for use with primary pistons which include internal moving parts. In alternative embodiments for engaging a primary piston 125 that include internal moving parts, such as an internal locking primary piston, the primary piston end of the booster piston rod 141 may include angular, conical or other variations in structural design in order to engage an outer perimeter surface of the primary piston 125. Variations of the FIG. 5 embodiment will be apparent to those skilled in the art, including adding additional booster pistons and additional booster piston housings, to increase the axial boost force.

In other alternative embodiments of the ram actuating mechanism 100 illustrated in FIG. 5, the booster piston housing 126 may be fixedly secured to the end cap 135 as opposed to the booster piston housing 126 being moveable within the housing sleeve 167. In this alternative embodiment the primary piston 125 may axially move within the housing sleeve 167, while the booster piston 129 axially moves within the sleeve portion 177 of the booster piston housing 126. In alternative embodiments, the primary piston end of the booster piston rod 141 may merely engage the primary piston 125 and not be fixedly secured to the primary piston 125

It may be appreciated that various changes to the details of the illustrated embodiments and systems may be made without departing from the spirit of the invention. While preferred embodiments of the present invention have been described and illustrated in detail, it is apparent that still further modifications and adaptations of the preferred and alternative embodiments will occur to those skilled in the art. However, it is to be expressly understood that such modifications and adaptations are within the spirit and scope of the present invention, which is set forth in the following claims.

What is claimed is:

1. A ram actuating mechanism for controlling the opening and closing of a ram block moveable along a ram axis within a blowout preventer body, the ram actuating mechanism comprising:

a front plate having a through bore therein;

a piston housing sealingly secured to the front plate, the piston housing including a housing sleeve and an end cap defining a housing chamber therein, the housing chamber having a central axis;

a primary piston within the housing chamber and in sealed engagement with the housing sleeve, the primary piston being moveable within the piston housing along the central axis of the chamber;

a ram rod fixed to the primary piston and extending through the through bore in the front plate to support the ram block;

a ram closing flow line for applying fluid pressure to a closing face of the primary piston to move the ram block toward the closed position;

a ram opening flow line for applying fluid pressure to an opening face of the primary piston to move the ram block toward the opened position;

one or more stationary booster piston guide blocks each positioned within the housing chamber;

a guide rod secured to the piston housing and each of the respective one or more booster piston guide blocks for fixedly securing each of the one or more piston guide blocks within the housing chamber;

one or more booster pistons each positioned within the housing chamber and moveable with respect to the piston housing from an opened position to a closed position, each booster piston including a front face for transmitting a booster force to the primary piston;

the one or more booster pistons including a sleeve portion spaced between a respective piston guide block and the housing sleeve;

each of the one or more booster pistons having a booster piston end plate spaced between a respective booster piston guide block and the piston housing end cap, each booster piston end plate having a through bore therein for receiving the guide rod; and the ram closing flow line applying fluid pressure to a closing face of each booster piston end plate for moving each booster piston toward a closed position and transmitting the booster force to the primary piston.

2. The ram actuating mechanism as defined in claim 1, wherein the sleeve portion is fixedly secured to a respective booster piston end plate.

3. The ram actuating mechanism as defined in claim 1, wherein the ram closing flow line passes radially between each of the one or more booster piston sleeves and the housing sleeve.

4. The ram actuating mechanism as defined in claim 1, wherein the ram opening flow line passes through the guide rod and into an opening cavity spaced between a piston guide block and a respective booster piston end plate.

5. The ram actuating mechanism as defined in claim 1, wherein the housing sleeve has a substantially uniform internal diameter extending from the front plate to the end cap.

6. The ram actuating mechanism as defined in claim 1, wherein each of the booster piston guide blocks supports one or more seals thereon for sealing engagement of a booster piston guide block with a respective booster piston.

7. The ram actuating mechanism as defined in claim 1, wherein the one or more booster pistons comprises:

a first booster piston sealing moveable with respect to a first booster piston guide block and having a first front face for transmitting a first booster force to the primary piston; and a second booster piston sealing moveable with respect to a second booster piston guide block and having a second front face for transmitting a second booster force to the first booster piston and then to the primary piston.

8. A ram actuating mechanism as defined in claim 1, wherein the ram opening flow line includes an opening passageway in the front plate, an opening flow line extending from the front plate to the rear end plate, and an opening passageway in the rear end plate.

9. The ram actuating mechanism as defined in claim 1, wherein the ram closing flow line includes a closing passageway in the front plate, a closing flow line extending from the front plate to the end cap, and a closing passageway in the end cap.

10. The ram actuating mechanism as defined in claim 1, wherein each of the one or more booster pistons has a substantially cup-shaped configuration with a respective booster piston guide block in sealing engagement with an inner cylindrical wall of the sleeve portion of the booster piston.

11. The ram actuating mechanism as defined in claim 1, further comprising:

a plurality of rods circumferentially spaced about the housing sleeve for securing the end cap to the front plate.

12. The ram actuating mechanism as defined in claim 1, further comprising:

the blowout preventer body having radially opposing chambers therein each for receiving a respective ram block; and the front plate forms a door removably connected to the blowout preventer body.

13. A ram actuating mechanism for controlling the opening and closing of a ram block moveable along a ram axis within a blowout preventer body, the ram actuating mechanism comprising:

a front plate having a through bore therein;

a piston housing sealing secured to the front plate, the piston housing including a housing sleeve and an end cap defining a housing chamber therein, the housing sleeve having a substantially uniform internal diameter extending from the front plate to the end cap, the housing chamber having a central axis;

a primary piston within the housing chamber and in sealed engagement with the housing sleeve, the primary piston carrying one or more seals for sealing engagement with the primary piston and the housing sleeve, the primary piston being moveable within the piston housing along the central axis of the chamber;

a ram rod fixed to the primary piston and extending through the through bore in the front plate to support the ram block;

a ram closing flow line for applying fluid pressure to a closing face of the primary piston to move the ram block toward the closed position;

a ram opening flow line for applying fluid pressure to an opening face of the primary piston to move the ram block toward the opened position;

one or more stationary booster piston guide blocks each positioned within the housing chamber;

a guide rod secured to the piston housing and each of the respective one or more booster piston guide blocks for fixedly securing each of the one or more piston guide blocks within the housing chamber;

one or more booster pistons each positioned within the housing chamber and having a sleeve portion spaced between a respective booster piston guide block and the housing sleeve and moveable with respect to the piston housing from an opened position to a closed position, the sleeve portion being in sealing engagement with a respective piston guide, each booster piston including a front face for transmitting a booster force to the primary piston;

each of the one or more booster piston guide block carrying one or more seals for sealing engagement of the guide block with the sleeve portion of a respective booster piston;

each of the one or more booster pistons having a booster piston end plate spaced between a respective piston guide block and the piston housing end cap, each booster piston end plate having a through bore therein for receiving the guide rod; and the ram closing flow line applying fluid pressure to a closing face of each booster piston end plate for moving each booster piston toward a closed position and transmitting the booster force to the primary piston.

14. The ram actuating mechanism as defined in claim 13, wherein the ram closing flow line passes radially between each of the one or more booster piston sleeves and the housing sleeve; and the ram opening flow line passes through the guide rod and into an opening cavity spaced between a piston guide block and a respective booster piston end plate.

15. The ram actuating mechanism as defined in claim 13, wherein the one or more booster pistons comprises:

a first booster piston sealing moveable with respect to a first booster piston guide block and having a first front face for transmitting a first booster force to the primary piston; and a second booster piston sealing moveable with respect to a second booster piston guide block and having a second front face for transmitting a second booster force to the first booster piston and then to the primary piston.

16. A ram actuating mechanism for controlling the opening and closing of a ram block moveable along a ram axis within a blowout preventer body, the ram actuating mechanism comprising:

a front plate having a through bore therein;

a piston housing sealingly secured to the front plate, the piston housing including a housing sleeve and an end cap defining a housing chamber therein, the housing chamber having a central axis;

a primary piston within the housing chamber and in sealed engagement with the housing sleeve, the primary piston being moveable within the piston housing along the central axis of the chamber;

a ram rod fixed to the primary piston and extending through the through bore in the front plate to support the ram block;

a ram closing flow line for applying fluid pressure to a closing face of the primary piston to move the ram block toward the closed position;

a ram opening flow line for applying fluid pressure to an opening face of the primary piston to move the ram block toward the opened position;

one or more booster pistons each positioned within the housing sleeve and movable with respect to the piston housing;

one or more booster piston housings each positioned within the housing chamber and having a sleeve portion spaced between a respective booster piston and the housing sleeve, each booster piston housing including an end plate for forming a sub-region within the booster piston housing between the end plate and the respective booster piston;

one or more booster piston rods each including a force transmitting surface for transmitting a booster force from the one or more booster pistons to the primary piston, and each one or more booster piston rods including a through bore for applying fluid pressure in the sub-region within a respective the booster piston housing, and each one more booster piston rods extending through a port in a respective end plate; and the ram closing flow line applying fluid pressure to a closing face of each booster piston for moving each booster piston toward a closed position and transmitting the booster force to the primary piston.

17. The ram actuating mechanism as defined in claim 16, wherein each of the one or more booster piston housings is movable with respect to the piston housing.

18. A blowout preventer including a pair of ram actuating mechanisms each for controlling the opening and closing of a ram block moveable along a ram axis within a blowout preventer body, the blowout preventer comprising:

the blowout preventer body having radially opposing chambers therein each for receiving a respective ram block;

a door removably connected to the blowout preventer body and having a through bore therein;

a piston housing sealing secured to the door, the piston housing including a housing sleeve and an end cap defining a housing chamber therein, the housing chamber having a central axis;

a primary piston within the housing chamber and in sealed engagement with the housing sleeve, the primary piston being moveable within the piston housing along the central axis of the chamber;

a ram closing flow line for applying fluid pressure to a closing face of the primary piston to move the ram block toward the closed position;

a ram opening flow line for applying fluid pressure to an opening face of the primary piston to move the ram block toward the opened position;

one or more booster pistons each positioned within the housing chamber and moveable with respect to the housing chamber from an opened position to a closed position;

a force transmitting member for transmitting a force from the one or more booster pistons to the primary piston;

one or more sleeve portions each positioned within the housing chamber, each sleeve portion providing a fluid passageway past a respective booster piston and between an outer surface of the sleeve portion and an inner surface of the piston housing;

a rod within the housing chamber, the rod having another fluid flow passageway therein for transferring fluid from the ram actuating mechanism during closing of the ram block; and the ram closing flow line applying fluid pressure to a closing face of each booster piston for moving each booster piston toward a closed position and transmitting the booster force to the primary piston, the ram closing flow line including the fluid passageway between each of the one or more sleeve portions and the housing sleeve.

19. The blowout preventer as defined in claim 18, wherein the one or more booster pistons comprises:

a first booster piston sealing moveable with respect to a first booster piston guide block and having a first front face for transmitting a first booster force to the primary piston; and a second booster piston sealing moveable with respect to a second booster piston guide block and having a second front face for transmitting a second booster force to the first booster piston and then to the primary piston.

20. A blowout preventer as defined in claim 18, wherein the ram opening flow line passes through the guide rod and into an opening cavity spaced between a piston guide block and a respective booster piston end plate.

21. A blowout preventer as defined in claim 18, wherein the ram opening flow line includes an opening passageway in the door, an opening flow line in the piston housing extending from the door to the rear end plate, and an opening passageway in the rear end plate.

22. The blowout preventer as defined in claim 21, wherein the ram closing flow line includes a closing passageway in the door, a closing flow line extending from the door to the end cap; and a closing passageway in the end cap.

23. The blowout preventer as defined in claim 18, further comprising:

a plurality of rods circumferentially spaced about the housing sleeve for securing the end cap to the door.

* * * * *